US005226365A

United States Patent [19]

Wieland

[11] Patent Number: 5,226,365

[45] Date of Patent: Jul. 13, 1993

[54] PRINTING PRESS CYLINDER WITH OSCILLATION DAMPING

[75] Inventor: Dieter J. Wieland, Rimpar, Fed. Rep. of Germany

[73] Assignee: Koenig & Bauer Aktiengesellschaft, Wurzburg, Fed. Rep. of Germany

[21] Appl. No.: 897,816

[22] Filed: Jun. 12, 1992

[30] Foreign Application Priority Data

Jun. 15, 1991 [DE] Fed. Rep. of Germany ..... 4119825

[51] Int. Cl.[5] ..... B41F 5/00

[52] U.S. Cl. ..... 101/328; 400/689

[58] Field of Search ..... 101/328, 409, 410, 415.1; 400/689; 29/110

[56] References Cited

U.S. PATENT DOCUMENTS

| | | | |
|---|---|---|---|
| 3,486,443 | 12/1969 | Kuramochi | 101/409 |
| 4,247,213 | 1/1981 | Wurscher | 400/689 |
| 4,453,848 | 6/1984 | Adkisson et al. | 400/689 |
| 4,563,951 | 1/1986 | Mathes et al. | 400/410 |

FOREIGN PATENT DOCUMENTS

| | | | |
|---|---|---|---|
| 686615 | 5/1964 | Canada | 400/689 |
| 0103101 | 7/1983 | European Pat. Off. . | |
| 0103102 | 7/1983 | European Pat. Off. . | |
| 0208039 | 1/1987 | European Pat. Off. | 400/689 |
| 0249419 | 12/1987 | European Pat. Off. | 400/689 |
| 3012060 | 3/1980 | Fed. Rep. of Germany . | |
| 3527711 | 8/1985 | Fed. Rep. of Germany . | |
| 0248762 | 11/1986 | Japan | 400/689 |
| 0280960 | 12/1986 | Japan | 400/689 |
| 0154377 | 6/1988 | Japan | 400/689 |

OTHER PUBLICATIONS

Forkel, D.: Der Holset-Frehschwingungsdampfer In: Konstruction, heft 11, 1956.

*Primary Examiner*—Eugene H. Eickholt

*Attorney, Agent, or Firm*—Jones, Tuller & Cooper

[57] ABSTRACT

A printing press cylinder with oscillation damping for a sheet-fed rotary printing press utilizes a hollow cylinder shell with interior oscillation damping core materials to dampen oscillation caused by the placement of channels in the shell. The oscillation damping core materials may include a solid cylinder core, oscillation damping materials, or a plurality of metal balls.

7 Claims, 7 Drawing Sheets

PRINTING PRESS CYLINDER WITH OSCILLATION DAMPING

FIELD OF THE INVENTION

The present invention is directed generally to a printing press cylinder with oscillation damping. More particularly, the present invention is directed to a printing press cylinder with oscillation damping for a sheet-fed rotary printing press. Most specifically, the present invention is directed to a printing press cylinder with oscillation damping to reduce oscillation caused by the gripper or plate clamping or sheet clamping device carrying channels in the cylinder. The printing press cylinder has an outer shell and an inner core. The shell is supported in side frames against axial movement by suitable axle journals. The core may be a single element or a plurality of elements. This core may be separated from the shell by an oscillation damping material and may be supported on core journals or may be held within the shell by the oscillation damping materials.

DESCRIPTION OF THE PRIOR ART

Printing press cylinders often have axially extending channels which carry various sheet grippers, printing plate clamping assemblies, rubber sheet clamping assemblies and the like. It is generally known that particularly in the case of printing press cylinders having a relatively small diameter, these channels allow the cylinder to distort during rotation and to possibly become somewhat eccentric. This eccentricity shifts as the cylinder rotates and thus is apt to give rise to resonant oscillation of a low frequency. These low-frequency oscillations act in a radial direction and can cause both printing inaccuracies as well as cylinder failures.

Various attempts have been made in the prior art devices to provide cylinders which are not sensitive to such oscillations. One such device is shown in German published, unexamined patent application DE-OS 30 12 060. This publication shows a press cylinder that is constructed using several pieces and in which materials of differing physical properties are used for oscillation damping. One limitation of press cylinders of this type is that a multi-piece construction entails substantial production and assembly efforts. Also, with a multi-piece construction, the production variations add up. With the use of materials with different physical properties, it is possible that during temperature changes that the cylinders may change their shape. It is also possible that the oscillation damping materials provide between the contact surfaces of the individual components can have an effect on the stability of the cylinder shape.

In the European patent document EP 01 03 101 there is shown a device that is usable to reduce the bending vibration caused by channel contortions or deformations in a printing press cylinder which is filled with a damping material. In this prior art device, elastic shafts are disposed in the interior of the cylinder and provide additional mass. This additional mass is applied in a off-center position and is in contact with the cylinder shell. Since this additional mass is not disposed along the central axis of rotation of the cylinder, a counterweight or balance is required. Additionally, this additional mass touches the interior wall of the cylinder shell in at least one place. Thus if oscillations occur, there is a constant mechanical stress on the cylinder shell at this point of contact. This constant stress can result in flattening or fatigue of the material and loss of oscillation damping effect. Also, as was the case with the previously described prior art device, the requirement of a multiple part structure requires a substantial expenditure in manufacturing costs and assembly time.

Another prior art printing press cylinder oscillation damping assembly can be seen in European patent document EP 01 03 102. In this prior device, a bar is fastened to the inside of the shell of the printing system cylinder. This bar transmits oscillations and is connected with an oscillation absorbing bar that is located in the cylinder channel. The absorbing bar carries additional mass and is embedded in a damping material. This prior art device also suffers the same limitations as does the previously discussed device and is again a multiple part structure which requires a significant expenditure of time and cost in manufacturing and assembly.

It will thus be apparent that a need exists for a printing cylinder oscillation damping assembly that overcomes the limitations of the prior art devices. The printing press cylinder with oscillation damping in accordance with the present invention provides such a device in a manner which is a significant improvement over the prior art devices.

SUMMARY OF THE INVENTION

It is an object of the present invention to provide a printing press cylinder with oscillation damping.

Another object of the present invention is to provide a printing press cylinder with oscillation damping in a sheet fed rotary printing machine.

A further object of the present invention is to provide a printing press cylinder with oscillation damping to reduce oscillations caused by the grippers or plate or sheet clamping devices carried in channels in the cylinder.

Yet another object of the present invention is to provide a printing press cylinder with oscillation damping which can be manufactured at low cost and with a high degree of precision.

Still a further object of the present invention is to provide a printing press cylinder with oscillation damping that has good damping properties and that counteracts bends of the cylinder caused by its own weight.

As will be set forth in detail in the description of the preferred embodiments which are presented subsequently, the printing pres cylinder with oscillation damping in accordance with the present invention utilizes a hollow cylinder shell that is supported for rotation by axle journals which also prevent the cylinder from shifting axially. The interior of the cylinder shell carries either a cylinder core or a core material such as a plurality of balls. In either case this interior core material provides a weight which is rotation symmetrical and which is effective in damping oscillations. The cylinder core or core material is either partially or entirely surrounded with an oscillation-damping material. This material can be a polymeric foam or can be a plurality of individual elements, such as balls.

A particular advantage of the present invention is that the core present in the cylinder chamber constitutes a counter-mass with respect to the cylinder shell and that the oscillation-damping material changes the oscillations or detains the resonant oscillations in such a way that these oscillations become harmless. Less stringent production tolerances, along with low manufacturing costs, are made possible because of the one-piece cast embodiment of the printing press cylinder. Axial bending of the printing press cylinder, particularly of slim cylinders, is prevented in one embodiment by the disposition of a ring-shaped bar, which extends coaxially around the core and is in contact with the cylinder shell Not only is a counter-mass with respect to the cylinder formed by means of the disposition of balls or pre-assembled ball containers in the interior of the printing press cylinder, but an oscillation-damping material is created at the same time. When ball containers are used, they can be attached directly to the cylinder shell close to the place where the oscillations are to be removed.

The printing press cylinder with oscillation damping in accordance with the present invention provides an assembly which is effective in counteracting oscillations in a rotary printing press cylinder. The assembly of the present invention overcomes the limitations of the prior art devices and is a substantial advance in the art.

BRIEF DESCRIPTION OF THE DRAWINGS

While the novel features of the printing press cylinder with oscillation damping in accordance with the present invention are set forth with particularity in the appended claims, a full and complete understanding of the invention may be had by referring to the detailed description of the preferred embodiments, as set forth subsequently, and as illustrated in the accompanying drawings, in which:

DESCRIPTION OF PREFERRED EMBODIMENTS

Figure 1:
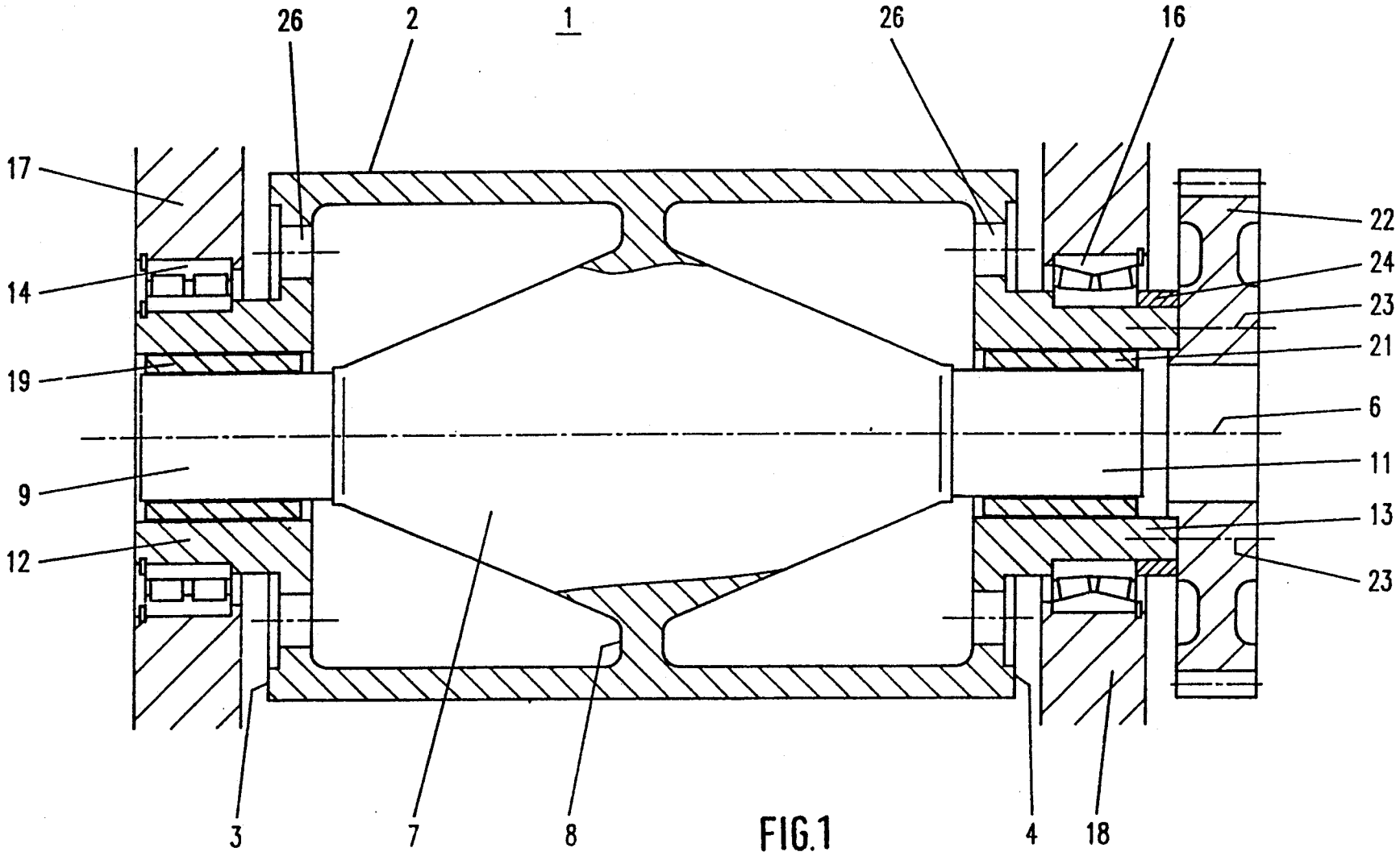
FIG. 1 is a longitudinal cross-sectional view of a first preferred embodiment of a printing press cylinder with oscillation damping in accordance with the present invention.
Figure 8:
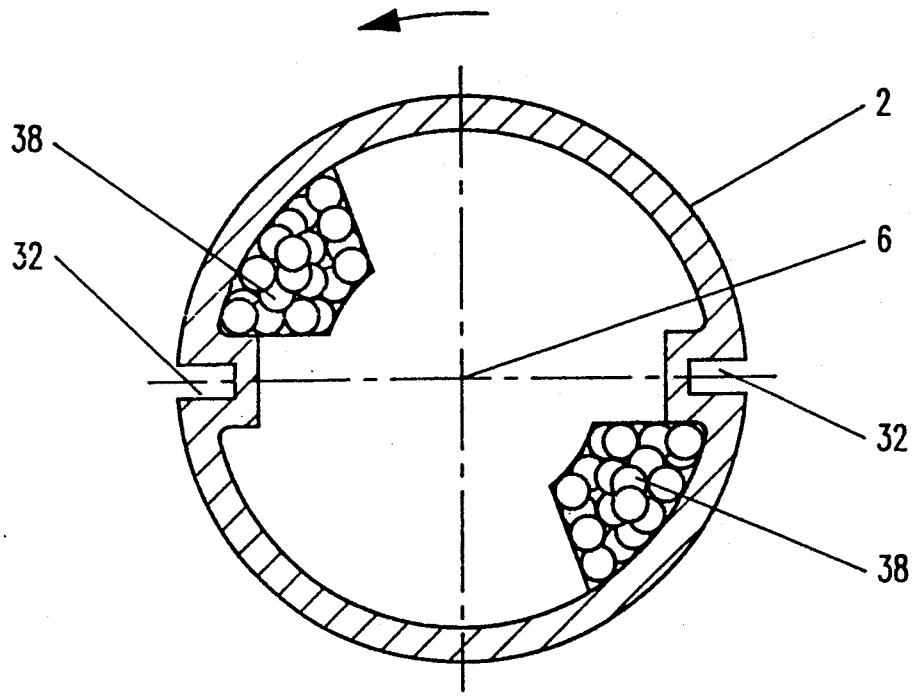
FIG. 8 is a transverse cross-sectional view of a seventh preferred embodiment of a printing press cylinder with oscillation damping in accordance with the present invention.
Figure 4:
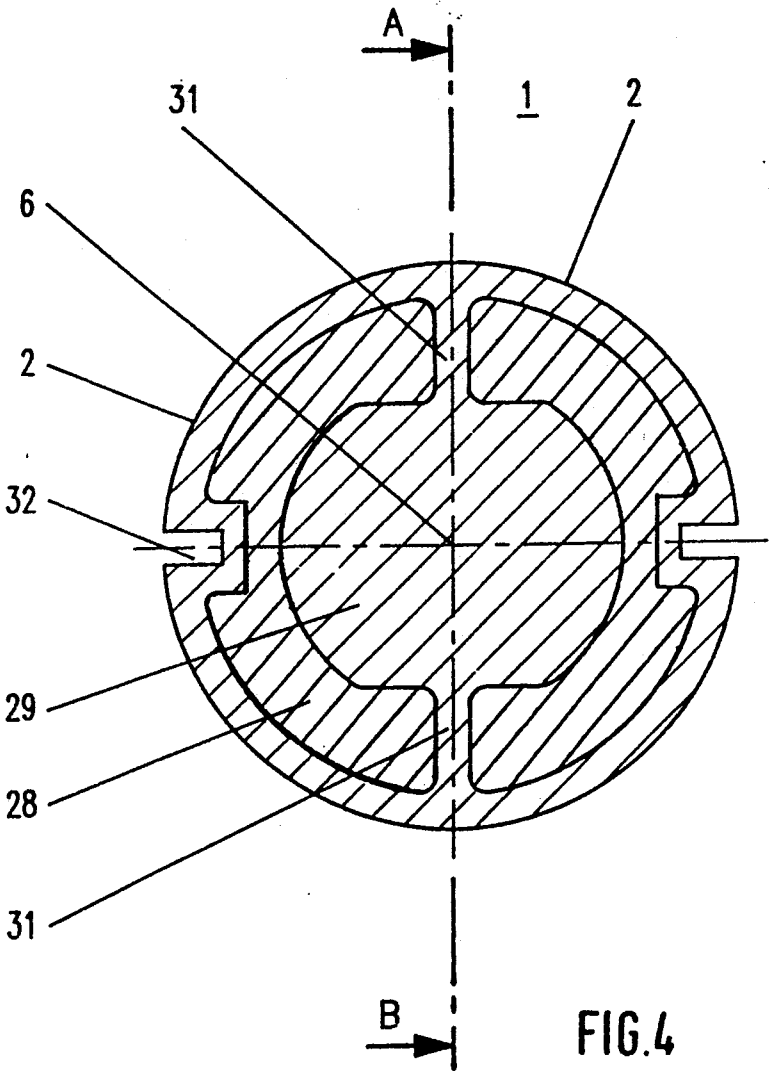
FIG. 4 is a transverse cross-sectional view through the cylinder of FIG. 3 and taken along line C-D of FIG. 3.

Referring initially to FIG. 1, there may be seen generally at 1, a first preferred embodiment of a printing press cylinder with oscillation damping in accordance with the present invention. In the longitudinal, cross-sectional view of the printing press cylinder, generally at 1, as seen in FIG. 1 there is not shown the inclusion of one or more cylinder channels and the various devices, such as printing plate or rubber sheet clamping devices or gripper devices which are customarily located in one or more of the channels. These cylinder channels are depicted somewhat schematically at 32 in FIGS. 4 and 8. It will be understood that these channels extend axially along the outer periphery of the cylinder 1, generally parallel to an axis of rotation 6 of the cylinder, and that there may be more or less channels 32 than are depicted in FIGS. 4 and 8.

The printing press cylinder 1, shown in FIG. 1, includes a one-piece, rotation-symmetrical cast body having a cylinder shell 2 and two cylinder end faces 3 and 4. In the interior of the cylinder shell 2 and also being a part of the printing press cylinder 1, is an approximately drum-shaped core 7. The cylinder core 7 extends in the direction of the cylinder axis 6 and is fixedly connected to the inside of the cylinder shell 2 by a ring-shaped bar 8 which is located centered in the axial direction. The cylinder core 7 has core journals 9 and 11 on its ends facing in the direction of the cylinder axis 6. The end faces 3 and 4 of the printing press cylinder shell 2 have axle journals 12 and 13 extending towards the exterior. These journals 12 and 13 are seated in walls of the press frame 17 and 18 by roller bearings 14 and 16. The two core journals 9 and 11 are connected in an oscillation-damping manner to the axle journals 12 and 13 by means of an oscillation-damping material, for example by bushings 19 and 21 of polyurethane. A drive gear wheel 22 is connected with the axle journal 13 by screws 23 and an interposed spacer ring 24. The printing press cylinder 1 has filling openings 26 on its end faces 3 and 4. It is made of cast steel or cast gray iron, for example. In accordance with present process technology, the core 7 is cast as one piece with the rest of the cylinder. The molding sand can be removed through the filling openings 26. Separation of the core journals 9 and 11 from the axle journals 12 and 13 takes place after pre-processing by means of chip removal.

When this first preferred embodiment of the printing press cylinder 1 is caused to be rotated, the cylinder shell 2 is caused to oscillate because of the structure of the channels 32 and their associated clamping assemblies. This oscillation is transmitted to the cylinder core 7 through the ring-shaped bar 8. The oscillations transmitted to the cylinder core are then transformed by friction from a mechanical force to heat energy in the bushings 19 and 21. One particular advantage of this first preferred embodiment lies in its one piece construction. The cylinder core 7, with its ring-shaped bar 8 is used simultaneously to dampen oscillations and also as a counter-pressure device to prevent bending of the printing press cylinder 1 in the radial direction.

Figure 2:
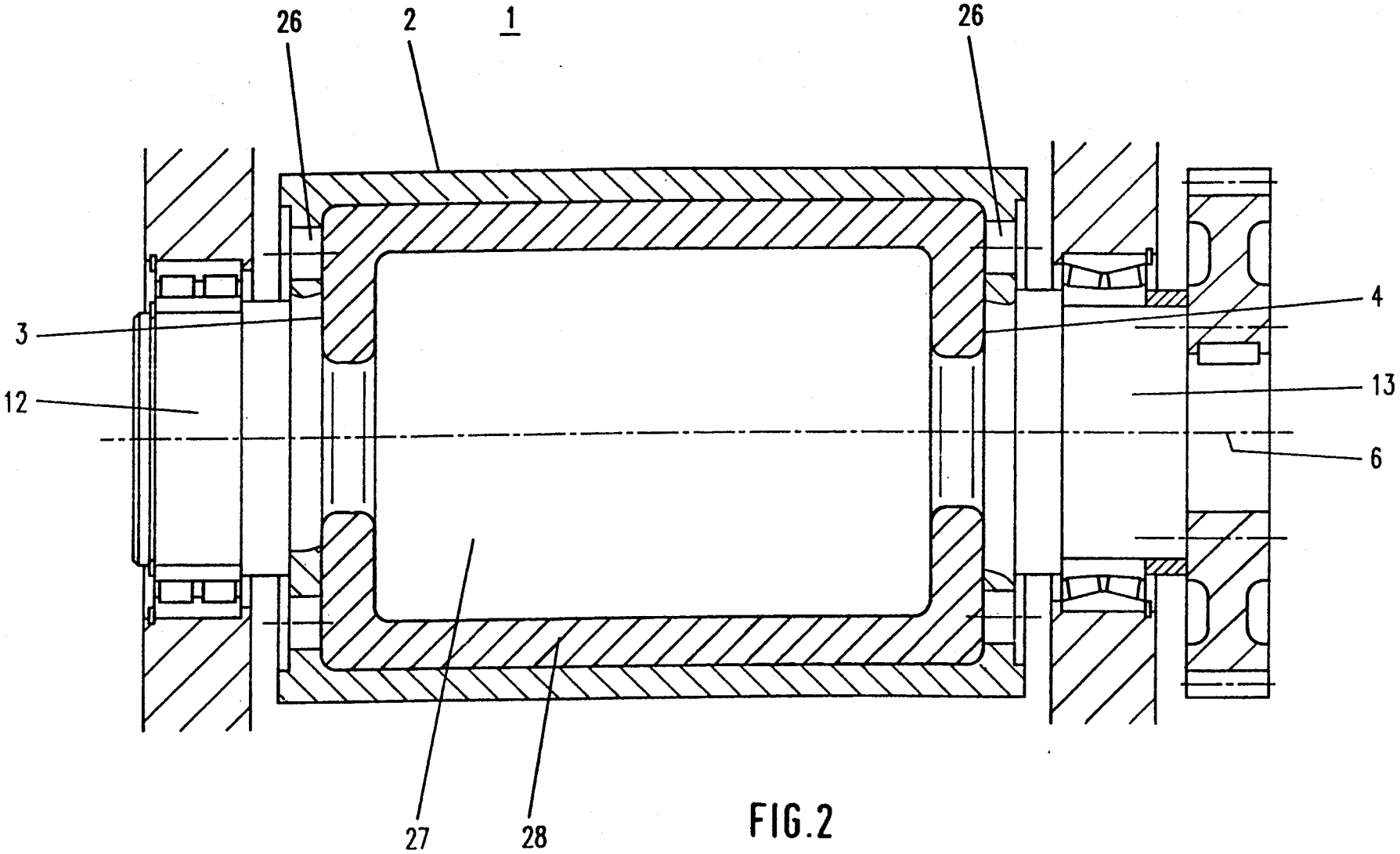
FIG. 2 is a longitudinal cross-sectional view of a second preferred embodiment of a printing press cylinder with oscillation damping.

Turning now to FIG. 2, there may be seen a second preferred embodiment of a printing press cylinder with oscillation damping in accordance with the present invention. In this and subsequent preferred embodiments, the same numbers will be used to identify corresponding elements in each embodiment. A longitudinal section through this second preferred embodiment of a one-piece printing press cylinder 1, which may be fabricated from cast steel or cast gray iron, is shown in FIG. 2. The cylinder core 27 is embodied to be generally cylinder-shaped and is fixedly connected in the axial direction 6 with the axle journals 12 and 13. On its end faces, the core 27 is partially connected with the end faces 3 and 4 of the printing press shell 2. The cylinder core 27 is totally connected with the inside of the cylinder shell 2 of the printing press cylinder 1 by means of oscillation-damping material 28 which surrounds the cylinder core 27.

In accordance with process technology, the cylinder core 27 was cast with the rest of the cylinder. The oscillation-damping material 28 can be inserted through filling openings 26 after removal of the molding sand. Such oscillation-damping material 28 can consist, for example, of polyurethane; bulk material such as sand; or of viscous oscillation damping media such as high-viscosity oil. When using viscous materials, it is desirable to employ a diaphragm, which is connected with the filling openings 26, for volume equalization.

The cylinder shell 2 of the printing press cylinder is excited to oscillate by the channel vibration. These oscillations are conveyed between the core 27 and the surface of the cylinder shell 2 as a result of the inserted oscillation-damping material 28. The core 27 acts as a counter-mass in respect to the oscillating surface of the cylinder shell 2. The oscillations are damped out in the oscillation-damping material 28. One of the advantages of this second preferred embodiment of the printing press cylinder with oscillation damping is its one-piece construction which allows low production tolerances and less costly manufacture.

Figure 3:
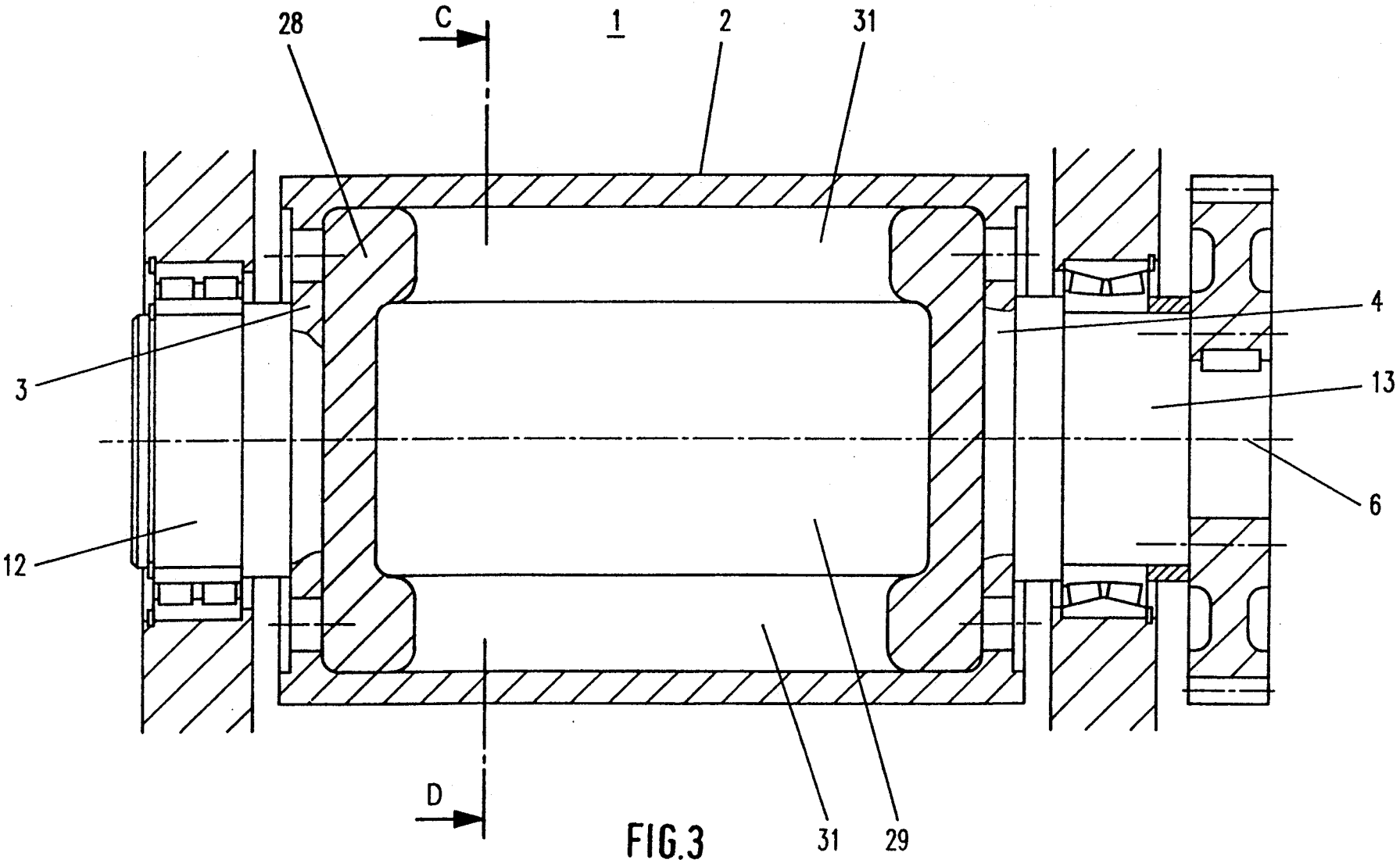
FIG. 3 is a longitudinal cross-sectional view of a third preferred embodiment of a printing press cylinder with oscillation damping.

Referring now to FIGS. 3 and 4, there may be seen a third preferred embodiment of a printing press cylinder with oscillation damping in accordance with the present invention. As may be seen in FIGS. 3 and 4 a cylinder core 29, which is essentially cylindrical, is fixedly connected with the inside of the cylinder shell 2 by two bars 31, located opposite from each other and extending radially from the cylinder axis 6. The bars 31 are disposed angularly offset in relation to the cylinder channels 32. The end faces 3 and 4 of the printing press cylinder 1 are fixedly connected with the axle journals 12 and 13. As previously described in connection with the second preferred embodiment of FIG. 2, the cylinder core 29 has been cast as one with the rest of the cylinder. The oscillation-damping materials 28 of FIG. 2 is also employed and is inserted into the interior of the cylinder shell 2 through the filling openings 26.

Figure 5:
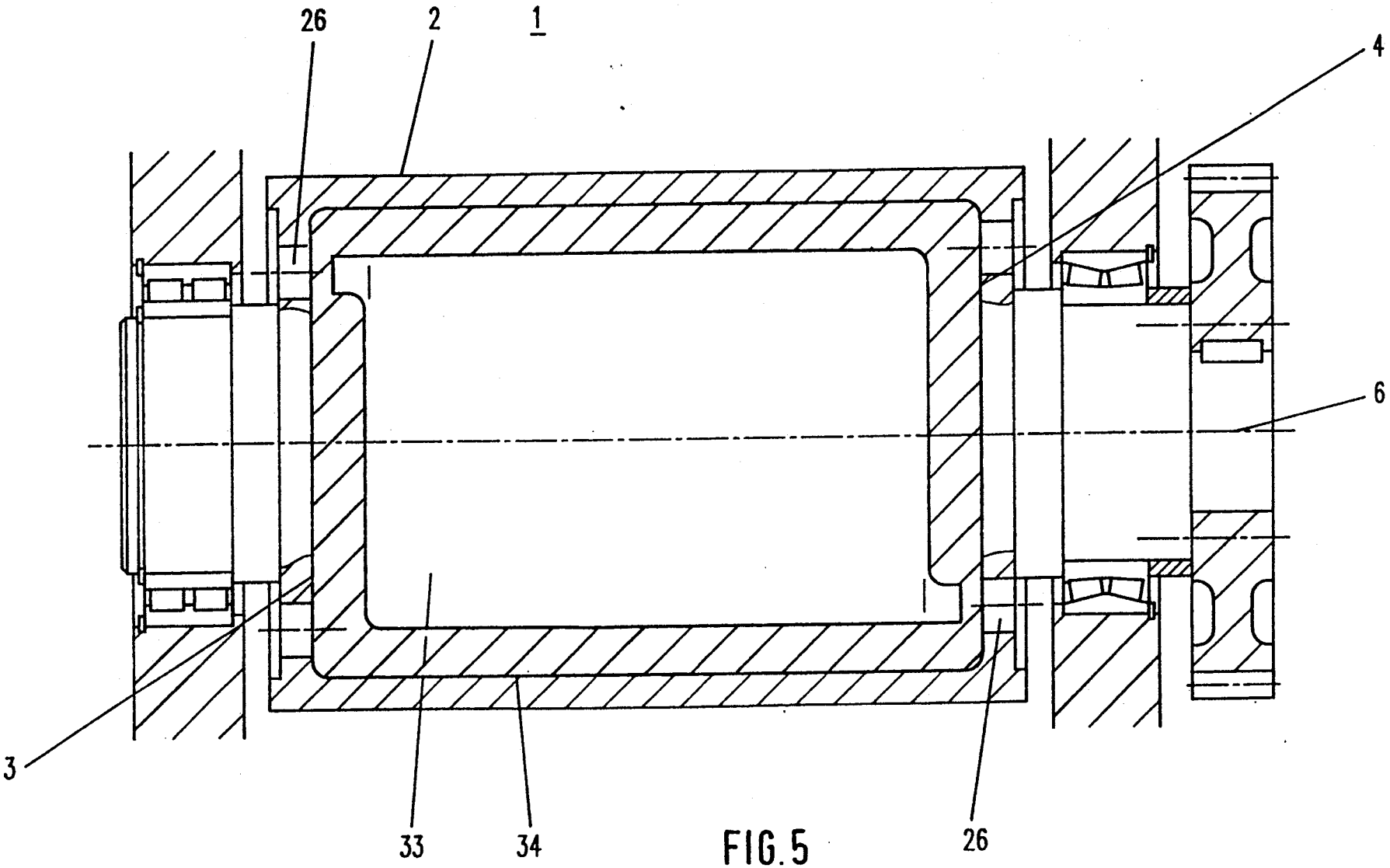
FIG. 5 is a longitudinal cross-sectional view of a fourth preferred embodiment of a printing press cylinder with oscillation damping in accordance with the present invention.

Turning now to FIG. 5, a longitudinal section through a fourth preferred embodiment of a one-piece printing press cylinder 1 in accordance with the invention is shown. The essentially cylindrical cylinder core 33 is completely surrounded by oscillation-damping material 34. The outer side of the oscillation-damping material 34 is in contact with the cylinder shell 2 and the end faces 3 and 4 of the printing press shell 2 of the cylinder 1. The end faces 3 and 4 are fixedly connected with the axle journals 12 and 13. In accordance with process technology, the cylinder core 33 is cast in one step together with the entire printing press cylinder i. After removal of the molding sand through the filling openings 26 and the molding the oscillation-damping material 34 around the core 33, the casting spurs which attach the core 33 to the shell 2 are separated from the cylinder shell 2 by boring so that there is no longer a metallic connection between the core 33 and the front faces 3 and 4 of the shell 2. As was the case with the previously described preferred embodiments, the cylinder shell 2 of the printing press cylinder 1 is excited to oscillate by the channel vibrations. These oscillations are converted in the oscillation-damping material 34. The core 33 is used as a counter-mass with respect to the cylinder shell 2. Polyurethane with a metallic granulate for mass adjustment can be advantageously used in this case as an oscillation-damping material. The weight of the oscillation-damping material 34 can be varied by changing the amount of metallic granulate added. The advantage of this fourth embodiment lies particularly in that in addition to the one-piece structure of the printing press cylinder 1, the core 33 is not metallically connected with the cylinder shell 2. In this way the printing press cylinder 1 itself has a lower oscillation-damping mass. The oscillations of the cylinder shell 2 can reach the core 33 only indirectly and through the oscillation-damping material 34.

Figure 6:
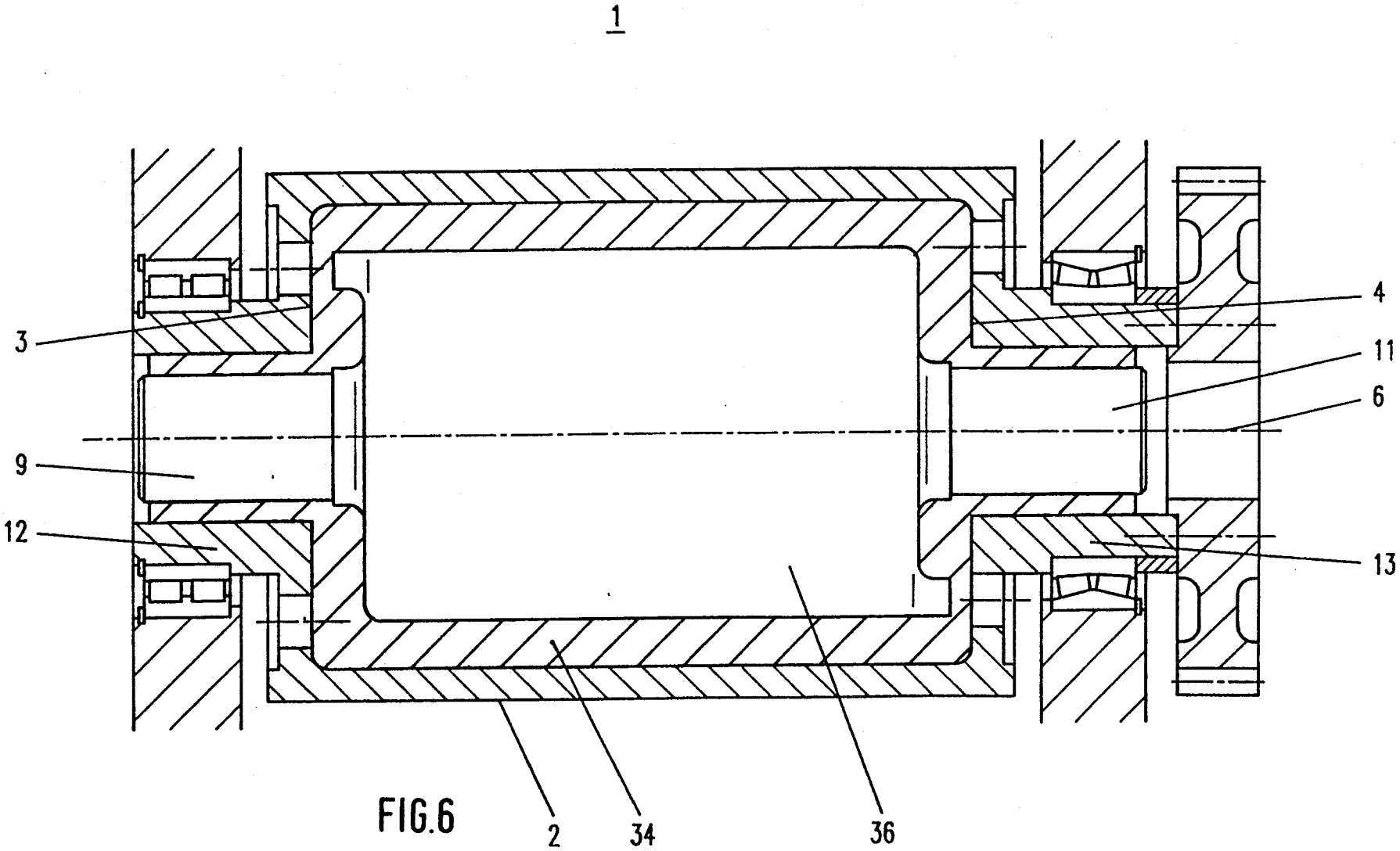
FIG. 6 is a longitudinal cross-sectional view of a fifth preferred embodiment of a printing press cylinder with oscillation damping.

In FIG. 6, there may be seen a longitudinal cross-sectional view of a fifth preferred embodiment of a printing press cylinder with oscillation damping in accordance with the present invention. In this fifth embodiment, the cylinder core 36 is generally cylindrical and has two core journals 9 and 11 at its axial ends. The cylinder shell 2, as was the situation with prior embodiments has end faces 3 and 4 which are provided with axle journals 12 and 13. In this embodiment, the cylinder core 36 was cast With the largest possible mass as one piece with the cylinder. After placing oscillation-damping material 34 around the core 36, the core 36 is separated from the cylinder shell 2 by removing the casting spurs by boring, so that the core 36 and the core journals 9 and 11 no longer have a metallic connection with the cylinder shell 2 or the cylinder end faces 3 and 4. The space between the core journals 9 and 11 and the axle journals 12 and 13 is also filled with oscillation-damping material 34 after the boring process.

Figure 7:
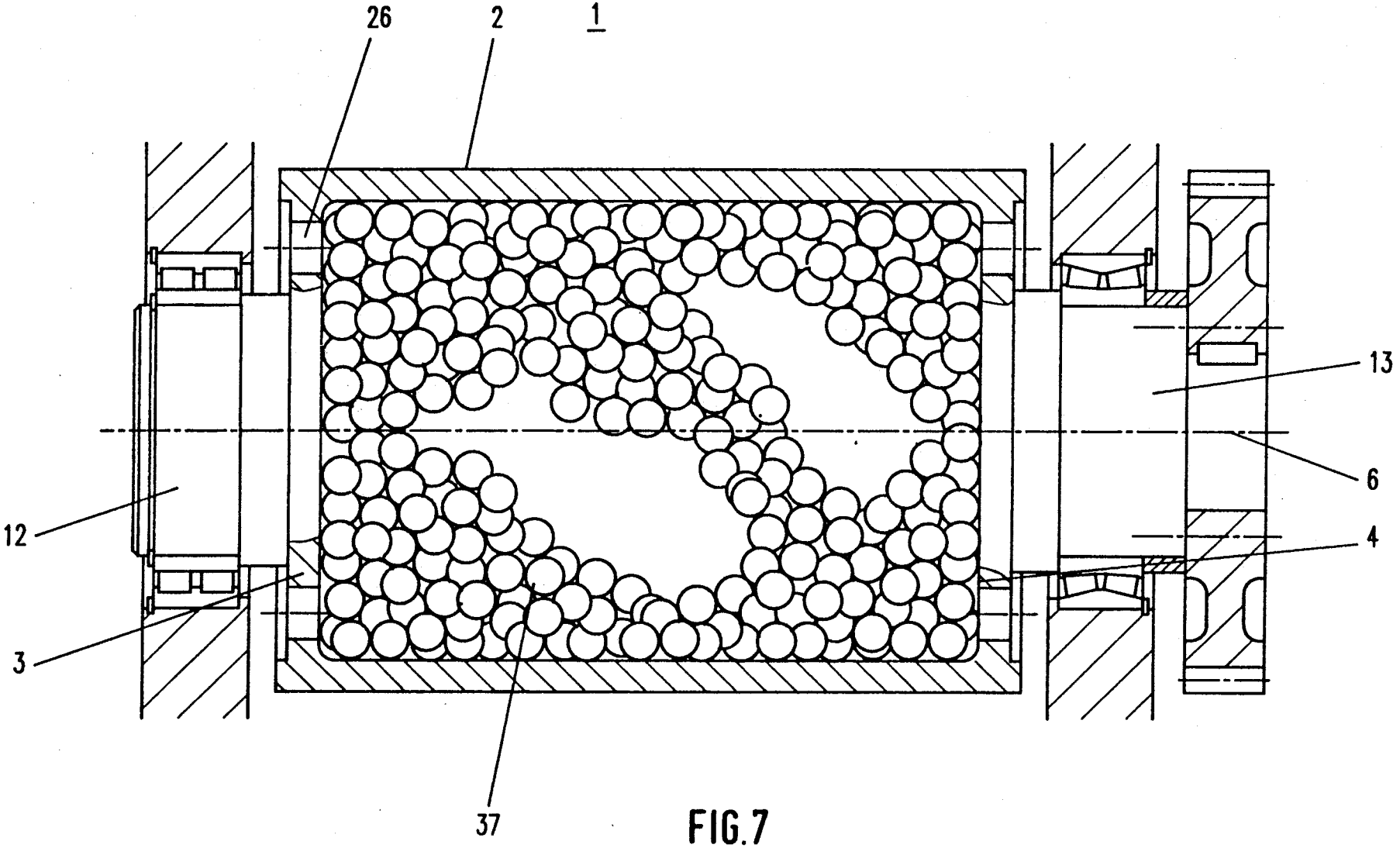
FIG. 7 is a longitudinal cross-sectional view of a sixth preferred embodiment of a printing press cylinder with oscillation damping.

There may be seen in FIG. 7, a sixth preferred embodiment of a printing press cylinder with oscillation damping in accordance with the present invention. In this embodiment the one piece cylinder shell 2 is securely connected with the end faces 3 and 4 and these end faces 3 and 4 are securely connected with the axle journals 12 and 13 which extend in an axial direction. Balls 37 have been inserted into the interior space formed by the cylinder shell 2 and the end faces 3 and 4 of the printing press cylinder 1. The balls 37 preferably have a diameter of 2.5 to 3 mm and preferably are made of steel. The balls 37 can be inserted through the filling openings 26. The balls 37 are used as the core as well as the oscillation-damping material. Compacting of the balls 37 can be performed by shaking. In addition, it is possible to dispose a pre-stressing device in the interior of the printing press cylinder 1 which, if needed, further compacts the balls 37. The cylinder can also be made of several parts. The cylinder shell 2 is excited to oscillate by the channel vibration. These oscillations are transferred to the balls 37 adjoining the inside of the cylinder shell 2. These oscillations are increasingly reduced by the impact and movement processes which cause losses of force. The oscillation effect can also be increased by additionally employing viscous damping agents, such as oil or grease which can be added to the space in the cylinder shell 2 in addition to the steel balls 37.

A seventh preferred embodiment of the printing press cylinder with oscillation damping is shown in FIG. 8 which is a transverse cross-sectional view of the printing press cylinder 1. In this seventh embodiment, the cylinder is shown having two diametrically spaced channels 32. The printing press cylinder shown in FIG. 8 is structured generally the same as the cylinder 1 which is shown in FIG. 7. The difference is that the entire cylinder chamber formed by the cylinder shell 2 and its end faces 3 and 4 is not filled with steel balls 37, as was the case in the device shown in FIG. 7. Instead, in this seventh preferred embodiment two ball-filled containers 38 are attached to the interior of the cylinder shell 2 adjacent the channels 32. These containers are diametrically spaced from each other and extend generally parallel to the axis of rotation 6 of the cylinder 1.

Since the cylinder channels 32 are the area of the cylinder 1 where the oscillations are generated, it is desirable to attach a ball container 38 adjacent each channel 32. It is advantageous to attach a plurality of evenly spaced, equally weighted ball containers 38 so that no added balancing is needed. In this seventh preferred embodiment, it is preferable to utilize steel balls having a diameter of 2.5 to 3 mm in the ball container 38. It will be understood that the printing press cylinder 1 of the seventh preferred embodiment must be made so that the ball container or containers 38 can be attached to the cylinder shell's inner walls. The cylinder can be made in several pieces or can have an end face that allows for the insertion and attachment of the ball containers 38. These containers must be firmly attached to the cylinder shell. They are preferably made of sheet metal and can be screwed or clamped or otherwise attached to the cylinder shell.

While preferred embodiments of a printing press cylinder with oscillation damping in accordance with the present invention have been set forth fully and completely hereinabove, it will be apparent to one of skill in the art that a number of changes in, for example, the length and diameter of the cylinder, the number of channels, the type of clamps or grippers placed in the channels and the like can be made without departing from the true spirit and scope of the subject invention which is accordingly to be limited only by the following claims.

What is claimed is:

1. A printing press cylinder with oscillation damping for use with a sheet-fed rotary printing machine, said printing press cylinder comprising:

a cylinder shell, said cylinder shell being supported for rotation about a rotational axis on spaced axle journals;

at least one axially extending channel on a peripheral surface of said cylinder shell, said channel carrying clamping means; and oscillation damping means positioned within said cylinder shell, said oscillation damping means including a cylinder core having axially extending core journals, said cylinder core being symmetrical about said rotational axis of said cylinder shell, said oscillation damping means being rotatable with said cylinder shell and camping oscillations in said cylinder shell.

2. The printing press cylinder with oscillation damping of claim 1 wherein oscillation damping material is positioned in an annular space between each of said core journals and a corresponding one of said axle journals.

3. The printing press cylinder with oscillation damping of claim 2 wherein said oscillation damping material is polyurethane.

4. The printing press cylinder with oscillation damping of claim 1 wherein said cylinder core has an outer core periphery spaced from an inner periphery of said cylinder shell, and an oscillation damping material positioned between said outer core periphery and said inner shell periphery.

5. The printing press cylinder with oscillation damping of claim 1 wherein said cylinder core has a ring shaped, radially outwardly extending bar, said bar being secured to an inner surface of said cylinder shell.

6. The printing press cylinder with oscillation damping of claims 4 wherein said oscillation damping material is polyurethane.

7. The printing press cylinder with oscillation damping of claim 4 wherein said oscillation damping material is polyurethane with metal granules.

* * * * *